United States Patent [19]

Hackenberg

[11] 4,121,754

[45] Oct. 24, 1978

[54] EASY-FILL BOX

[75] Inventor: Robert A. Hackenberg, East Lyme, Conn.

[73] Assignee: Robertson Paper Box Co., Inc., Montville, Conn.

[21] Appl. No.: 871,560

[22] Filed: Jan. 23, 1978

[51] Int. Cl.[2] ..... B65D 5/10

[52] U.S. Cl. ..... 229/38

[58] Field of Search ..... 229/38

[56] References Cited

U.S. PATENT DOCUMENTS

| | | | |
|---|---|---|---|
| 306,172 | 10/1884 | Munson | 229/38 |
| 307,897 | 11/1884 | Arthur | 229/38 |
| 344,367 | 6/1886 | Fiske | 229/38 |
| 610,474 | 9/1898 | Cowles | 229/38 |
| 1,351,278 | 8/1920 | Billstein | 229/38 |
| 4,050,625 | 9/1977 | Rice et al. | 229/38 |

*Primary Examiner*—Davis T. Moorhead

*Attorney, Agent, or Firm*—Cesari and McKenna

[57] ABSTRACT

A box for containing an article having a relatively stiff planar portion positioned flush against the front or back wall of the box and an internal tuck closure flap hinged to the front or back wall at an end of the box includes a tab hinged to the wall of the box opposite the closure flap hinge that folds inwardly so that when the closure flap is tucked inside the box to close off an end of the box the closure flap overlaps the tab. The tab prevents the article from hanging up on the edge of the closure flap or interfering with the tucking of the closure flap inside the box.

3 Claims, 7 Drawing Figures

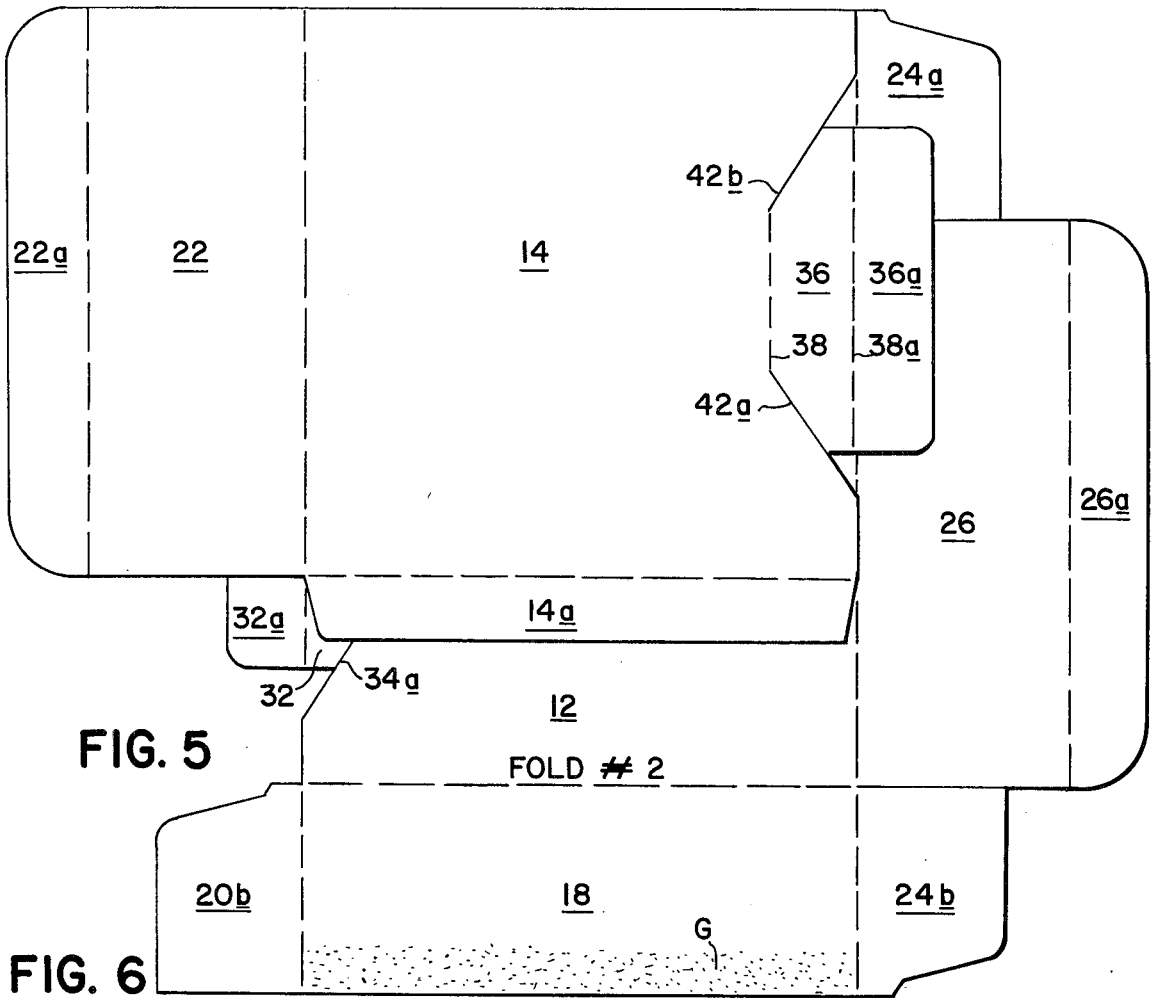
FIG. 5
FIG. 6
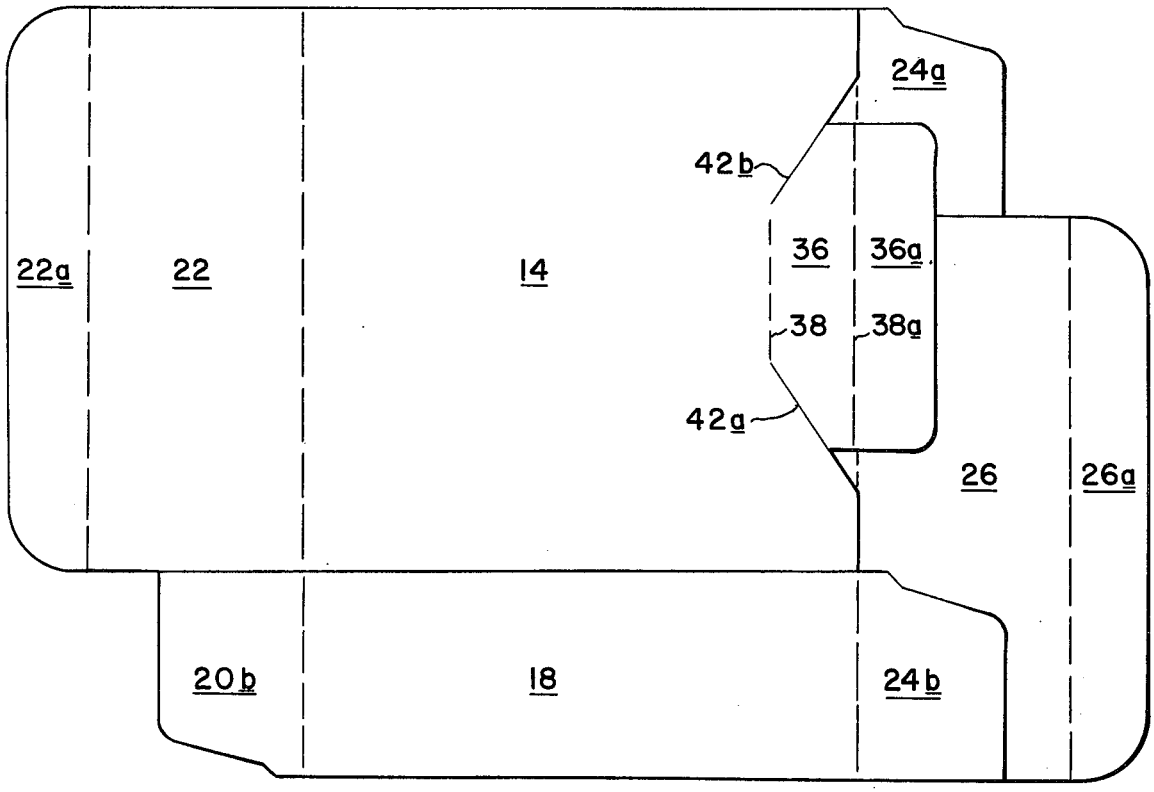

EASY-FILL BOX

BACKGROUND OF THE INVENTION

This invention relates to a box construction. It relates more particularly to a cardboard box that is particularly designed to contain one or more articles having a relatively stiff portion that lies against the front or rear wall of the box. Examples of such articles are a set of sanding disks, playing cards, a plastic tray containing various objects, etc.

When such articles are loaded into boxes of this general type from the top, a bottom edge thereof tends to hang up on the edge of the bottom closure flap tucked into the bottom of the box. Thus, not only is it difficult to load such articles, but also in many cases such engagement with the bottom flap pushes that flap open so that it must be tucked in again.

Also the very same articles make it difficult to tuck the top closure flap inside the box adjacent the front wall after the box is filled. This is because one such article is usually pressed flush against that wall. This problem is particularly acute when the articles are products such as sandpaper disks having a very coarse surface. The edge of the cover flap either becomes hung up on the edge of a disk or on the grit particles covering the front face of the disk which are usually oriented toward the front of the box so that the purchaser can observe coarseness of the disks.

SUMMARY OF THE INVENTION

Accordingly the present invention aims to provide a box which is designed particularly to contain one or more articles having a relatively stiff portion positioned flush against the front or rear wall of the box.

A further object of the invention is to provide a cardboard box having hinged closure flaps which can be tucked easily into the box to close the flaps.

A further object of the invention is to provide a box of this general type which provides added reinforcement at one or both ends of the box to minimize the chances of the closure flaps being opened inadvertently because of motion of the box contents.

Yet another object of the invention is to provide a box of this general type which can be transported and stored in a flat state.

Another object of the invention is to provide a cardboard blank for making a box having one or more of the above characteristics.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly the present box has the usual four walls and top and bottom closure flaps hinged to the front or rear wall of the box. Each closure flap is closed by tucking its margin opposite the hinge into the box so that it lies flush against the wall of the box opposite the hinge. In these respects, the present box is identical to prior comparable boxes of this type.

However to facilitate insertion of articles into the box which have relatively stiff portions that lie adjacent to the front or rear wall of the box, a tab is formed in the box wall adjacent the edge margin of the bottom closure flap that is tucked into the box to close that flap.

That tab is hinged to the box wall along a line parallel to the closure flap hinge at a location spaced from the bottom end of the box a distance somewhat greater than the height of the edge margin of the bottom closure flap. Thus the tab underlies the upwardly facing edge of the closure flap.

When a set of articles such as playing cards are inserted into the box from the top, the playing card positioned flush against the box wall containing the tab avoids becoming hung up on the edge of the closure flap by riding over that edge on the tab which thereupon functions more or less like a ramp. Thus all of the playing cards in the set can be inserted into the box together.

The width of the tab may depend upon the type of article to be contained in the box. For example, in the case of playing cards, the tab may extend almost to the side walls of the box. On the other hand, if the articles are round such as sanding disks, a narrower tab maybe employed since it is only the lowermost sector of a sanding disk that has to be guided over the bottom closure flap edge by the tab.

The edge of the tab opposite the bottom closure flap hinge can be co-linear with the bottom edge of the associated box wall. More preferably, however, that tab edge is hinged to a tab extension that is folded inward so that the tab extension lies between the articles in the box and the bottom closure flap. In this way, the tab and tab extension supplement the usual bottom closure so that positive connections exists between the closure members and both the front and rear walls of the box. This minimizes the chances of moving articles in the box forcing open the box bottom closure when the box is handled roughly.

A similar tab may be formed at the top of the box in the box wall against which the edge margin of the top closure flap is tucked when closing the top of the box after it is filled with such articles. Here again, the particular configuration of the tab depends upon the shape of the articles in the box and if the articles are more or less symmetric, the top tab is more or less identical to the bottom tab. After the box is filled, the tab is folded inward presenting a smooth surface to the edge margin of the closure flap as that is tucked inside the box. The tab thus functions as a ramp to guide the cover flap margin between the box wall and the top edge and face of the article adjacent that wall. Consequently even if the article is a sandpaper disk which presents a very rough and abrasive surface, the tab shields the closure flap margin from that surface so that the flap slides smoothly and easily into place between the article and the box wall. Here again, if the tab includes a tab extension folded in so that it overlies the articles in the box, it adds significantly to the strength of the top closure.

It should be understood that the adjectives "top" and "bottom" are used for convenience only since boxes of this type can be filled from the top or bottom and even turned on a side and be filled sideways. Thus, the present invention has application whenever a cover flap is likely to engage or be engaged by an article in the box when filling the box or closing it. As such, the invention may be used at one end of a box having a completely different closure or even no closure at its opposite end.

Thus the present box construction greatly facilitates filling boxes with stiff flat articles such as playing cards, sanding disks and the like. Yet the cost of manufacturing the box should not be appreciably greater than the cost of making conventional boxes of this type, particularly if the box does not include the recited tab extensions. Moreover, the present box is made so that it can normally be shipped and stored in a "knocked-down" condition for efficient space utilization and be set up easily when the time comes to fill the box.

BRIEF DESCRIPTION OF THE DRAWINGS

For a fuller understanding of the nature and objects of this invention, reference should be had to the following detailed description taken in connection with the accompanying drawings, in which:

FIGS. 5 and 6 are similar views showing how the box blank is folded to make the FIG. 1 box.

DESCRIPTION OF THE PREFERRED EMBODIMENT

Figure 1:
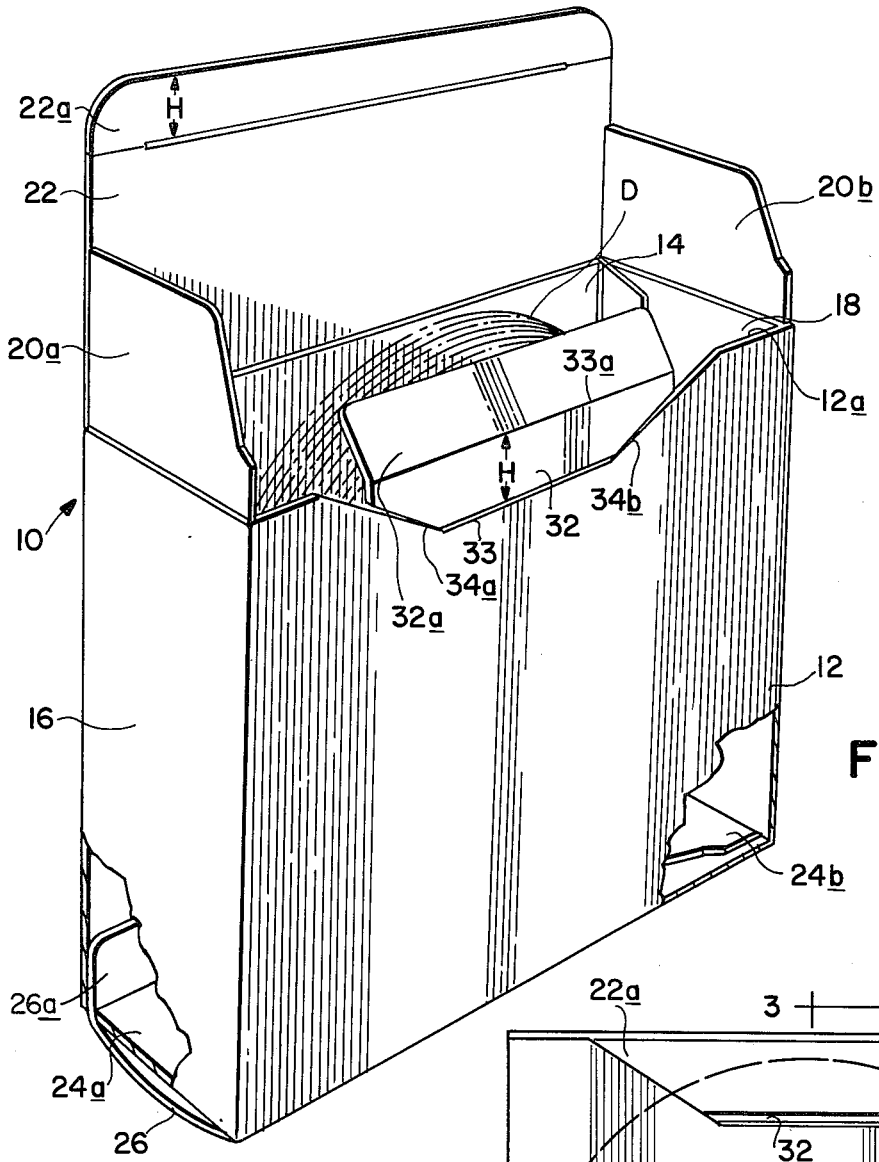
FIG. 1 is a perspective view of a box and its contents with the top of the box shown open.

Referring now to FIG. 1 of the drawings, the box made in accordance with this invention is designed particularly to contain stiff planar articles such as a set of sanding disks D inserted edgewise into the box so that disks at the opposite ends of the set lie flush against the front and rear box walls 12 and 14 respectively. Generally, articles of this type are somewhat resilient so that the outermost disks tend to be pressed against the box walls 12 and 14 so that there is little or no space between those walls and the articles. In addition to its front and rear walls, box 10 includes the usual side walls 16 and 18, with all the walls being hinged together to form a generally rectangular container.

Box 10 also includes the usual auxiliary cover flaps **20*a* and 20*b* hinged to the top edges of the side walls 16 and 18 respectively and a main top cover flap 22 higned to the top edge of the rear wall 14. The bottom of the box is closed by auxiliary cover flaps 24*a* and 24*b* hinged to the box side walls and a main cover flap 26 hinged to front wall 12**.

Hinged to the top edge of the cover flap 22 is a flap extension **22*a* that is normally tucked into the box adjacent the front wall 12 when closing that cover flap. In the present instance, however this is difficult because of the presence of the frontmost sanding disk D pressed against wall 12. This disk usually has its abasive face facing forwardly for marketing reasons so that the edge of the flap extension 22*a* tends to become hung up on the edge of that disk. Even if one is successful in fitting extension 22*a* between disk D and wall 12**, it is difficult to slide it fully into the box because of the presence of the grit particles on the disk.

To avoid the aforesaid problems, the present box includes a tab 32 hinged at 33 to the box wall 12 near the top of the box. The hinge line 33 is preferably parallel to the top edge **12*a* of wall 12 and it is spaced from that edge by a distance that equals or exceeds the height H of the cover flap extension 22*a***.

Preferably tab 32 is formed by slitting the box front wall 12 from its top edge **12*a* as at 34*a* and 34*b* in FIG. 1 down to the opposite ends of hinge line 33. In the illustrated box embodiment, slits 34*a* and 34*b* are oblique because disks D are round and thus narrow adjacent the ends of the box. However, the slits could just as well be vertical in which case the hinge line 33 would be coextensive with the maximum width of tab 32**.

Preferably also, tab 32 has a tab extension **32*a* hinged at 33*a* to the top edge of tab 32. In use, the tab extension is folded inward so that it overlies the tops of the disks D. Then, following inward folding of the auxiliary cover flaps 20*a* and 20*b*, the main cover flap 22 can be folded down with its extension 22*a* sliding over tab 32 and its extension 32*a* so that the flap extension is guided by that tab into its fully tucked position flush against the front wall 12 as best seen in FIGS. 2 and 3B**.

Thus the tab 32 and its extension function as a ramp to guide the flap extension **22*a* over the top edge of the forwardmost disk D and into the space between that disk and front wall 12. Since the height of tab 32 equals or exceeds that of flap extension 22*a*, the edge of that extension is free to extend down through slits 34*a* and 34*b* between tab 32 and wall 12 so that the free edge of extension 22*a* is more or less co-linear with hinge line 33. As seen from the drawing figures, then, the side portions of the box wall 12 engage the ends of flap extension 22*a* while the tab 32** engages the central portion of that extension from the opposite side with the result that the cover flap as a whole is securely retained in its tucked position.

Figure 2:
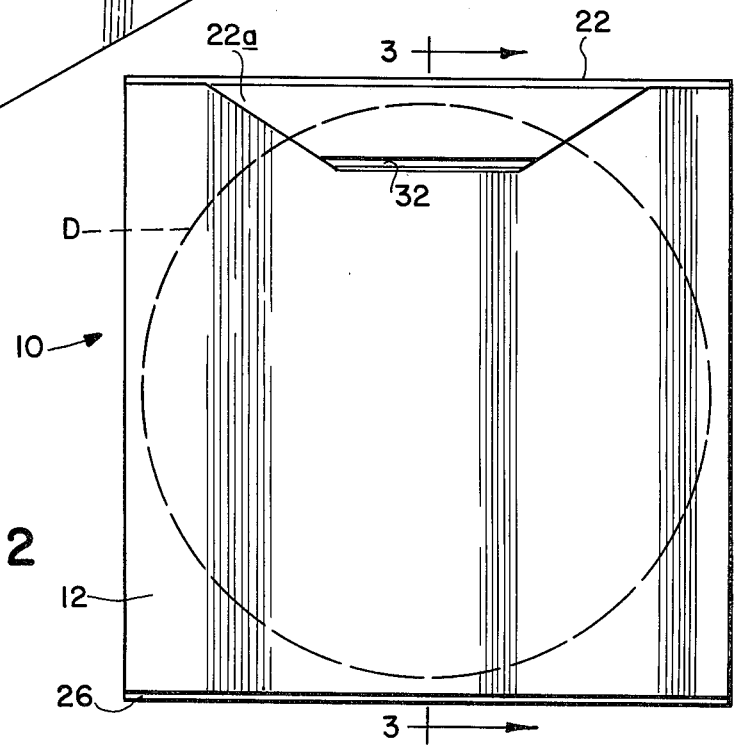
FIG. 2 is a front elevational view of the FIG. 1 box with the top of the box closed.
Figure 3A:
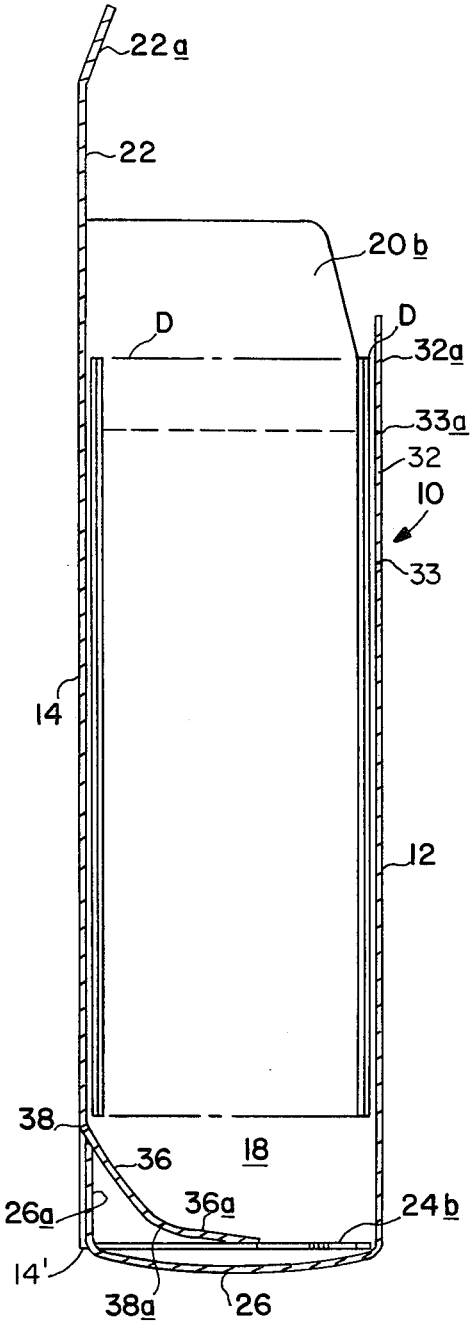
FIG. 3A is sectional view along line 3—3 of FIG. 2 with the box cover open and the box contents shown partially inserted into the box.
Figure 3B:
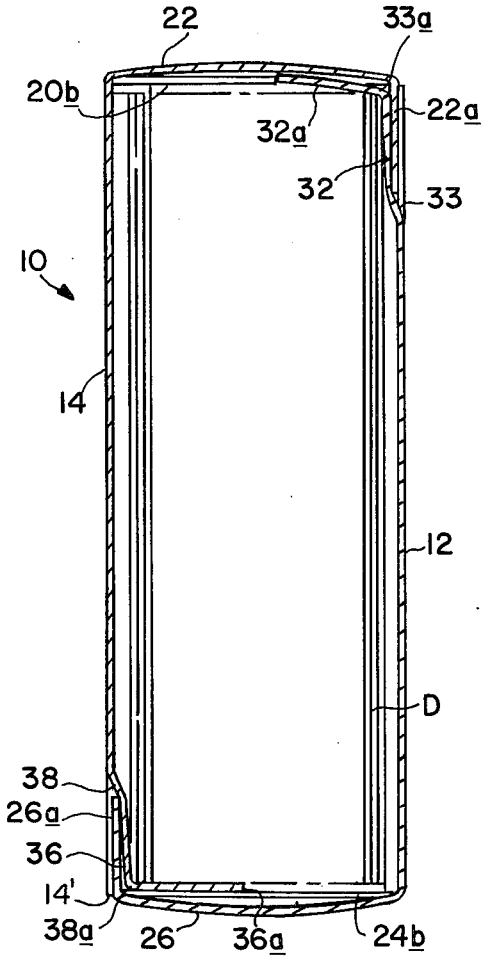
FIG. 3B is a sectional view along line 3—3 of FIG. 2 showing the box contents fully seated and the top cover closed.

It is also to be noted that should the frontmost disk D present a rough or abrasive surface to the cover flap extension **22*a* as it is being tucked into the box, the tab 32 isolates the flap extension from that surface so that the flap slides easily into position between tab 32 and wall 12 as best seen in FIGS. 2 and 3B**.

The tab 32 and its extension **32*a* also strengthen the closure at the top of the box. More particularly, since they are folded inward between disks D and the closure flaps 20, 22 when the box cover is closed as in FIG. 3B, they provide, with the conventional cover flaps, positive connections between the closure as a whole and the front, rear and side walls of the box. Therefore the tab helps to inhibit any tendency of the disks pushing the cover flaps open when the box 10** is shaken or handled roughly.

Also while the tab 32 is shown on a box of the type having a bottom closure more or less the same as the top closure, it could just as well be used to facilitate closing the cover of a box having a different type of bottom closure such as, for example, one comprising hinged flaps which fold downward and interfit automatically when the box is made up.

As best seen in FIGS. 3A and 3B, box 10 can also be formed with a bottom tabs 36 and **36*a*, similar to tab 32 and its extension 32*a* adjacent to the bottom closure 26 to facilitate loading stiff planar articles such as disks D into box 10. More particularly, tab 36 is connected along hinge line 38 to the box rear wall 14 adjacent to the bottom cover flap extension 26*a* when that cover flap is closed. The hinge line 38 is spaced parallel to the bottom edge 14' of the box wall 14 a distance equal to or exceeding the height H (FIG. 4) of the bottom flap extension 26*a*. The flap 36 is formed by slitting the box wall 14 obliquely at 42*a* and 42*b* from its bottom edge 14' to the opposite ends of the hinge line 38**.

Desirably also tab 36 includes an extension **36*a* hinged at 38*a* to the lower edge of tab 36. When the box bottom cover is closed, the tab and its extension repose inside the box as illustrated in FIGS. 3A with the tab 36 being angled inwardly and its extension 36***a* lying against the auxiliary cover flaps 24*a* and 24*b* thus forming a bridge or ramp over the upper edge of the bottom cover flap extension 26*a*. When articles such as disks D are loaded into the box, the bottom edge of the rearmost disk engages tab 36 and its extension 36*a* so that it is guided to its fully seated position shown in FIG. 3B. Thus all disks D slide freely and at once to the bottom of the box.

Actually, since the tab 36 does tend to project inwardly to some extent, the extension 36*a* can be omitted in some instances because the tab 36 is sufficiently resilient to guide the lower edge of the disk adjacent wall 14 past the edge of flap extension 26*a* before the tab is deflected laterally by the disk.

It will also be appreciated that tab 36 and its extension 36*a* reinforce the bottom of the box just as the tab 32 and its extension 32*a* strengthen the top of the box to help contain the box contents. And, of course, the tab 38 can facilitate loading articles such as disks D into a box having an entirely different type of top closure.

It will also be understood that the length and specific shape of tabs 32 and 36 may depend upon the shape of the article inserted into the box. Thus to save material, the illustrated tabs are relatively narrow since the sector of the disk D that interferes with flap extension 32*a* and 36*a* is itself relatively narrow. If the articles in the box are more or less the same width as the box, e.g. playing cards, the tabs 32 and 36 may be made wider. As a general rule, however, sufficient material should be left at the sides of the front and rear walls of the box adjacent the tab to permit the cover flap extensions 22*a* and 26*a* to interfit between those box wall side portions and the adjacent tab.

Figure 4:
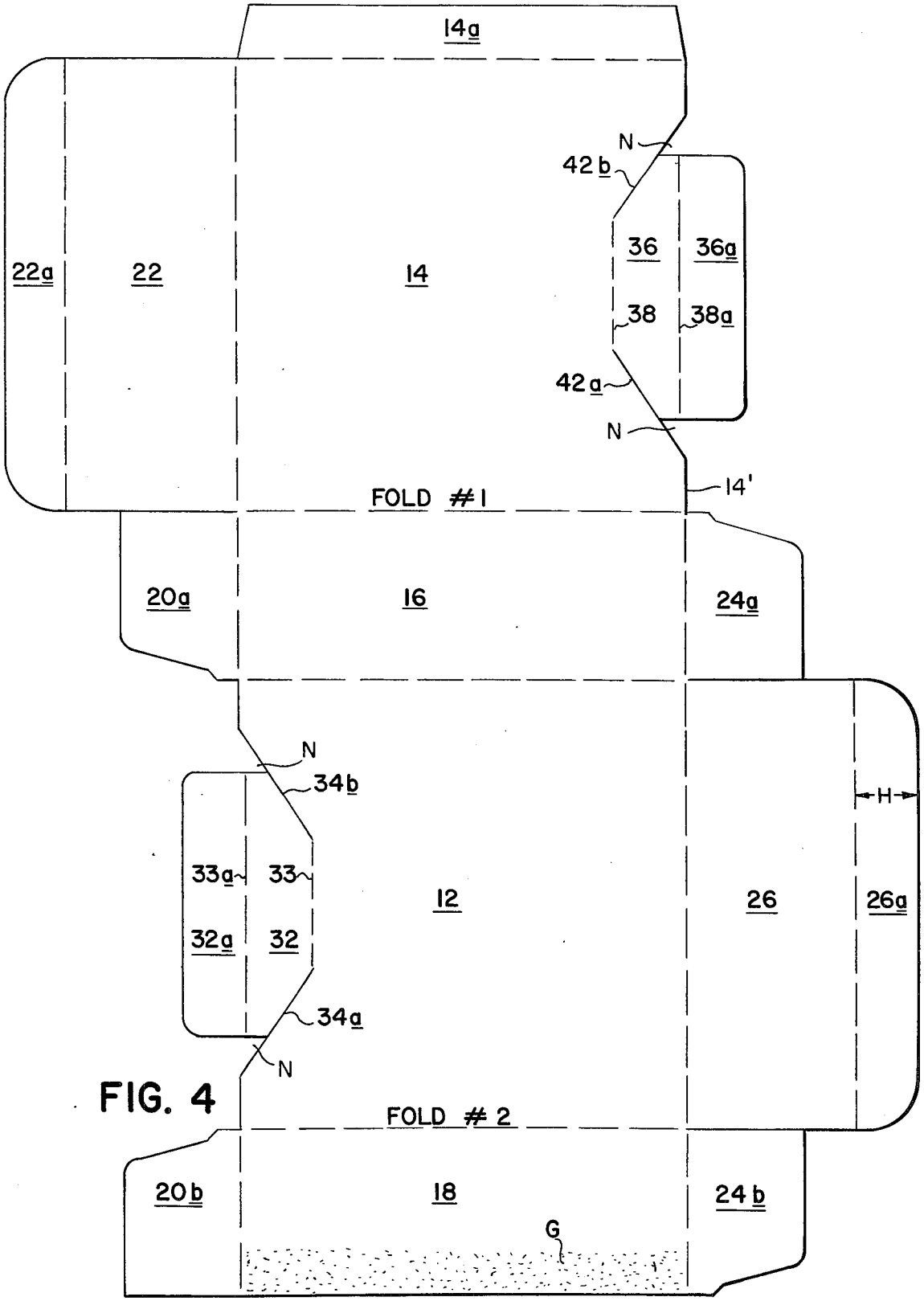
FIG. 4 is a top plan view of the blank from which the FIG. 1 box is formed.

Referring now to FIGS. 4 through 6, the blank used to form the FIG. 1 box is quite similar to the usual blank for making a box having hinged-type top and bottom cover flaps. The panels in the box blank shown in those figures bear the same identifying numbers as the corresponding parts in the box illustrated in FIGS. 1 to 3. Of course the box blank includes the usual glue flap 14*a* hinged to the rear wall panel 14 which adheres to a glue line G applied on sidewall panel 18 when the blank is folded first at Fold #1 and then at Fold #2 as shown in FIGS. 5 and 6 to form the knocked-down box. The box is normally stored and shipped in that condition until set up for use as in FIG. 1.

The blank illustrated in FIGS. 4 to 6 is different, however, in that it includes tab 32 and its extension 32*a* hinged at 33 to the front wall panel 12. The blank is slit obliquely at 34*a* and 34*b* to extend the roots of the tab to the hinge line 33 giving the tab 32 a height at least equal to the height of the cover flap extension 22*a*. The illustrated tab and tab extension 32 and 32*a* are relatively narrow because of the shape of disks D. Therefore the sides of tab 32 are trimmed forming a notch N at each side of the tab to remove a small wedge of material that could become bent and possibly interfere with the closing of the cover flap 22.

The tab 36 and its extension 36*a* are formed in exactly the same way in panel 14 at the opposite side of the blank by slitting panel 14 along oblique lines 42*a* and 42*b* from its edge 14′ obliquely to opposite ends of the hinge line 38. Here again, notches N are formed at opposite sides of tab 36 for the same reasons discussed above in connection with tab 32.

It will be seen from the foregoing, then, that the inclusion of bridging tabs at the opposite ends of a box facilitate inserting rigid planar articles into the box and also facilitate closing the cover after the box is filled with such articles. In addition, the bridging tabs described above help to reinforce the box end closures so that the box contents can not inadvertently force open the closures and fall out of the box. Yet with all of these advantages, the cost of making this box should not be appreciably greater than that of prior comparable boxes of this type since the only added material which may be involved is the relatively small tab extensions 32*a* and 36*a*.

It will thus be seen that the objects set forth above, among those made apparent in the preceding description, are efficiently attained and since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic ad specific features of the invention herein described.

I claim:

1. A box having a closure on at least one end of the box of the type including a cover flap hinged to one wall of the box and arranged to be folded down with its edge margin opposite the hinge tucked in adjacent to the opposite wall of the box to close that end of the box and which is intended to contain one or more articles having a relatively stiff planar portion lying flush against said opposite box wall, the improvement comprising a tab hinged to said opposite box wall near said one end of the box, A. the height of said tab between said hinge and its opposite edge being at least equal to the height of the cover flap margin that is tucked in adjacent said opposite wall when the cover flap is closed, B. the width of said tab being less than the full width of said opposite wall so that when said cover flap is closed, its said edge margin interfits between said tab and said opposite wall, C. said tab being defined by a pair of slits extending from the adjacent edge of said opposite wall to the opposite ends of said hinge, said slits being angled with respect to said hinge.

2. The box defined in claim 1

A. wherein the height of the tab is at least equal to the height of the cover flap margin, and B. further including means defining a hinge line extending across the tab more or less co-linear with said box end so that a portion of the tab forms a tab extension that folds more or less flush against the cover flap when that is closed.

3. The box defined in claim 2 and further including an additional cover flap and tab situated at the opposite end of the box similar to the cover flap and tab at said one end of the box.

* * * * *